US006112659A

United States Patent [19]

Huang

[11] Patent Number: 6,112,659

[45] **Date of Patent: *Sep. 5, 2000**

[54] ADHESIVE TAPE DISPENSER PROVIDED WITH MEANS FOR PRINTING ADHESIVE TAPE BEING DISPENSED

[76] Inventor: Harrison Huang, No. 23, Lin T'So Rd., Shengkang, Taichung Hsien, Taiwan

[ * ] Notice: This patent is subject to a terminal disclaimer.

[21] Appl. No.: 09/349,454

[22] Filed: Jul. 8, 1999

[51] Int. Cl.[7] ..... B41F 13/56

[52] U.S. Cl. ..... 101/226; 101/212; 101/288

[58] Field of Search ..... 101/212, 213, 101/226, 288, 351.1, 351.2, 351.3

[56] References Cited

U.S. PATENT DOCUMENTS

| | | | |
|---|---|---|---|
| 2,223,907 | 12/1940 | Bronfman | 101/226 |
| 2,302,179 | 11/1942 | Bronfman | 101/288 |
| 2,323,976 | 7/1943 | Chalmers | 101/216 |
| 2,432,202 | 12/1947 | Mason | 101/227 |
| 2,598,892 | 6/1952 | Critchlow, Jr. et al. | 154/121 |
| 4,957,233 | 9/1990 | Samuelson | 225/26 |
| 5,947,025 | 9/1999 | Huang | 101/288 |

*Primary Examiner*—Ren Yan
*Assistant Examiner*—Leslie J. Grohusky
*Attorney, Agent, or Firm*—Browdy and Neimark

[57] ABSTRACT

An adhesive tape dispenser comprises a base, a tape roll mounting portion disposed at one end of the base, a tape cutting tool disposed at other end of the base, a printing cylinder pivoted to the base, an ink supplying device located on the base and under the printing cylinder, and a cover fastened pivotally with the base. As the adhesive tape is dispensed, the underside of the dispensed tape comes in contact with the printing cylinder. When the printing cylinder is actuated to turn by the dispensed tape, the dispensed tape is printed by the printing plate of the printing cylinder. The printing plate is continuously provided with ink by an ink cylinder of the ink supplying device.

10 Claims, 7 Drawing Sheets

ADHESIVE TAPE DISPENSER PROVIDED WITH MEANS FOR PRINTING ADHESIVE TAPE BEING DISPENSED

FIELD OF THE INVENTION

The present invention relates generally to an adhesive tape dispenser and more particularly to a desk-top adhesive tape dispenser provided with a means for printing words or patterns on the adhesive tape that is being dispensed.

BACKGROUND OF THE INVENTION

The adhesive tapes are widely used in packaging and are often printed thereon with words, trademarks, patterns, etc., which are printed in advance at an extra cost. Such adhesive tapes as described above are generally custom-made and are thus expensive. As a result, only big corporations can afford such a luxury.

Applicant had filed a application which number is 09/075,850 is allowed, now U.S. Pat. No. 5,947,025.

SUMMARY OF THE INVENTION

The primary objective of the present invention is therefore to provide a desktop adhesive tape dispenser having a means for printing a word or pattern on a piece of tape being dispensed.

In keeping with the principle of the present invention, the foregoing objective of the present invention is attained by an adhesive tape dispenser comprising a base, a tape roll mounting portion disposed at one end of the base, a tape cutting tool disposed at other end of the base, a printing cylinder pivoted to the midsection of the base, an ink supplying device located on the base and under the printing cylinder, and a cover fastened pivotally with the base. As the adhesive tape is dispensed, the underside of the dispensed tape comes in contact with the printing cylinder. When the printing cylinder is actuated to turn by the dispensed tape, the dispensed tape is printed by the printing plate. The printing plate is continuously provided with ink by an ink cylinder of the ink supplying device.

The foregoing objective, features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
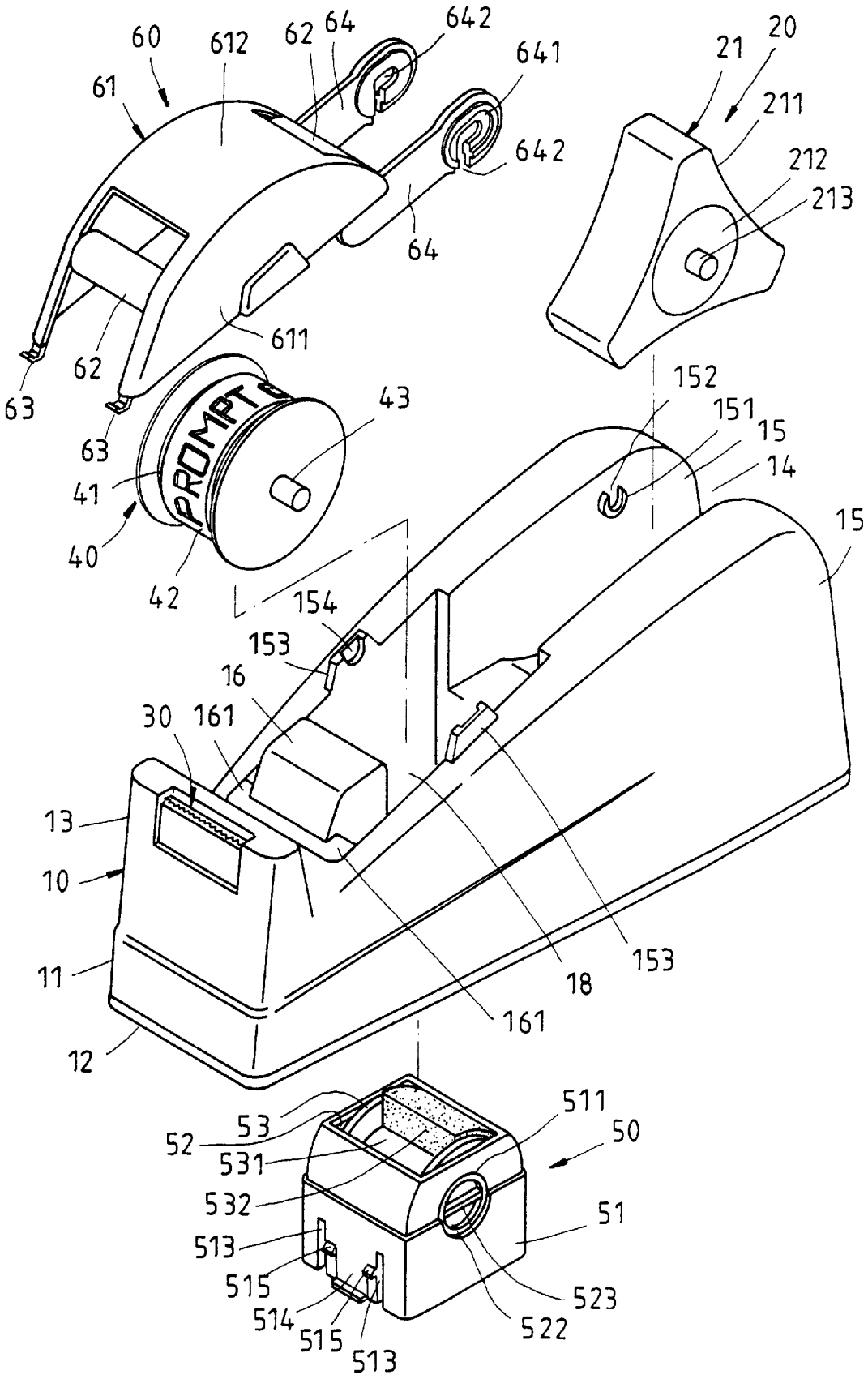
FIG. 1 shows a partial exploded view of the preferred embodiment of the present invention.
Figure 2:
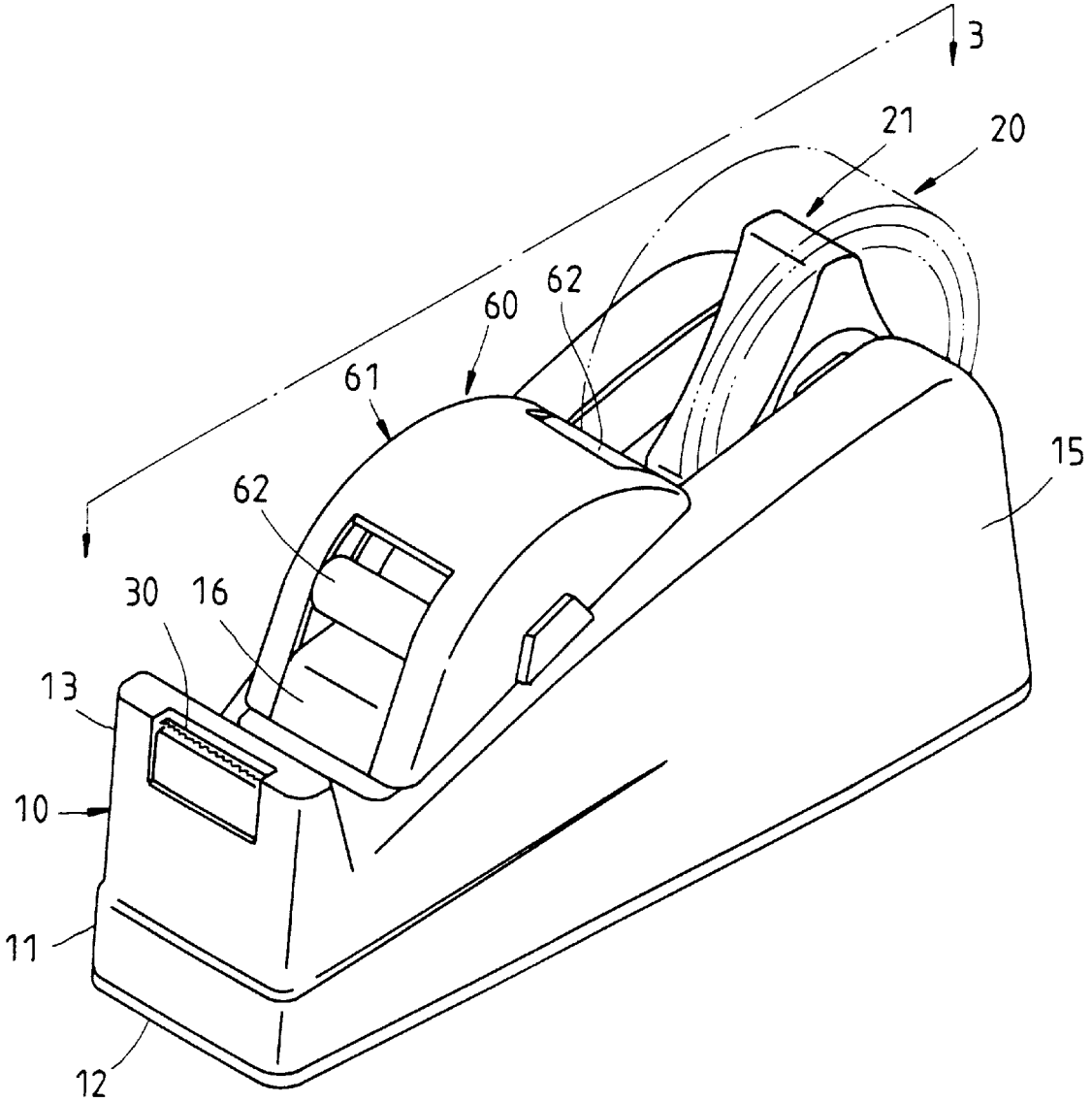
FIG. 2 shows a perspective view of the preferred embodiment of the present invention in combination.

As shown in all drawings, an adhesive tape dispenser embodied in the present invention comprises a base 10, an adhesive tape roll mounting portion 20 located at one end of the base 10, a tape cutting tool 30 located at other end of the base 10, a printing cylinder 40 located in the middle of the base 10, an ink supplying device 50 located under the printing cylinder 40, and a press cover 60 fastened pivotally with the base 10.

Figure 3:
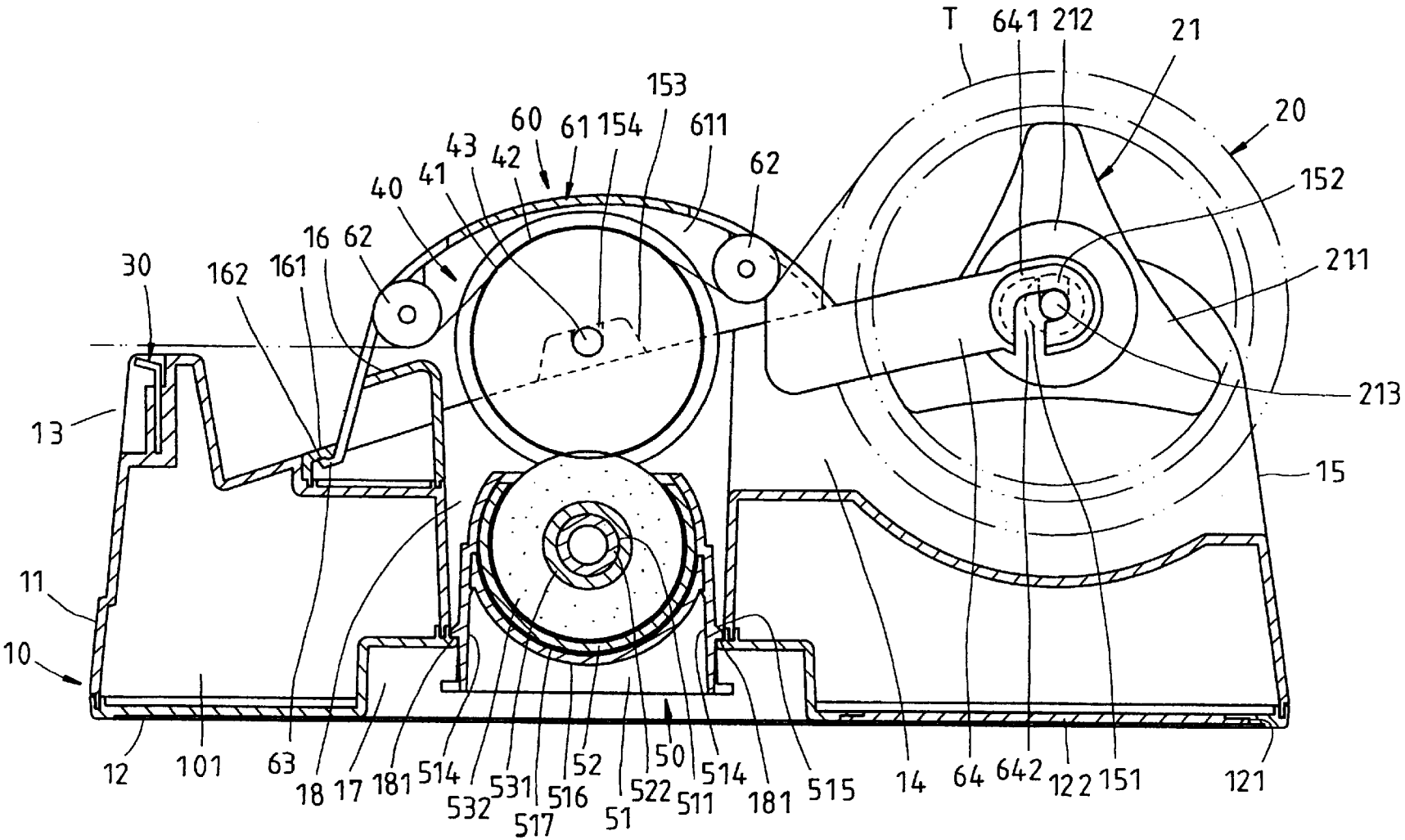
FIG. 3 shows a sectional view of a portion taken along the direction indicated by a line 3–3 as shown in FIG. 2.
Figure 5:
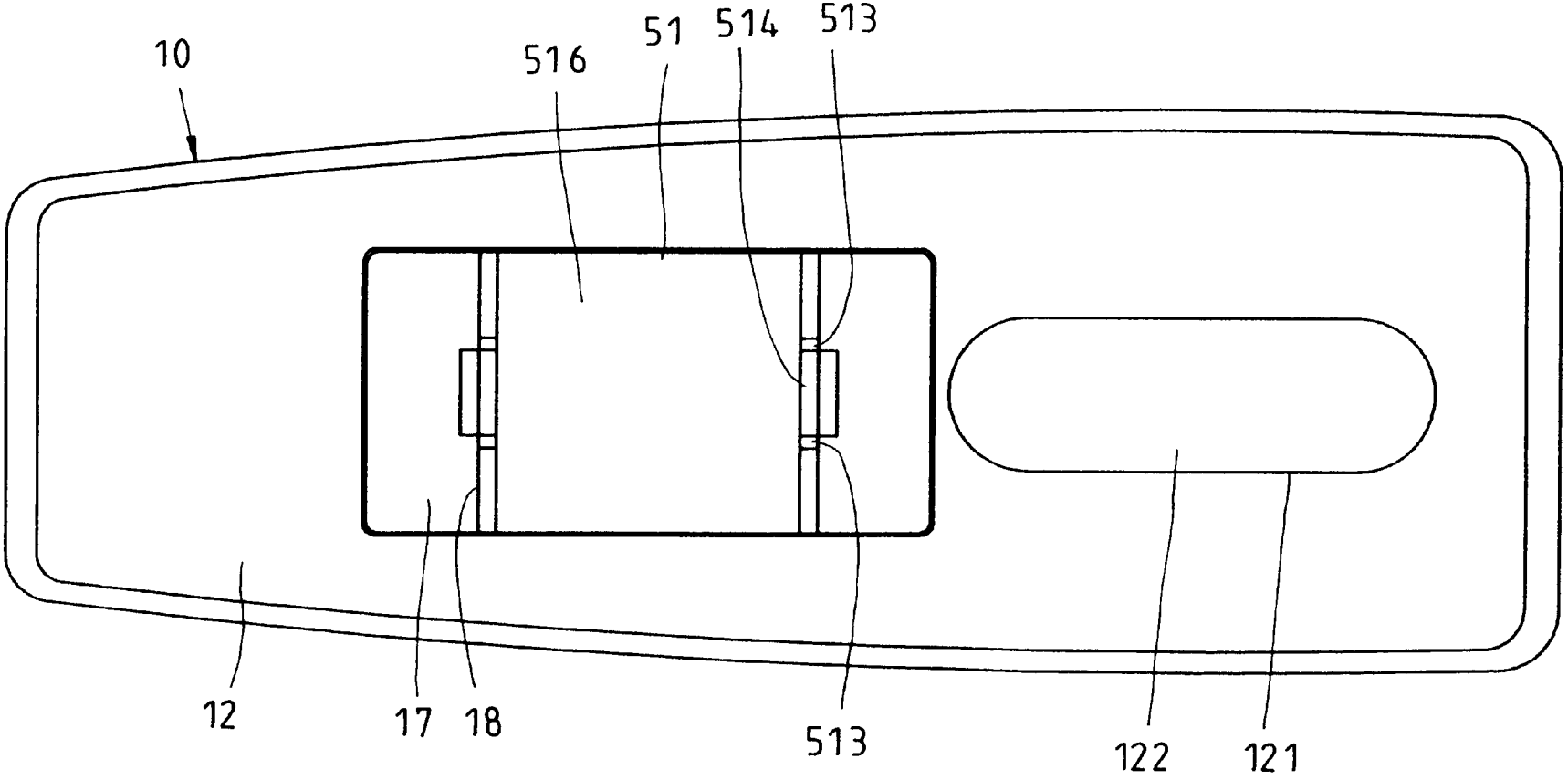
FIG. 5 shows a bottom view of the preferred embodiment of the present invention as shown in FIG. 2.

The base 10 rested on a surface, such as a desktop, and is formed of a top shell 11 and a bottom plate 12. The base 10 is provided with a closed compartment 101 full of sand which is put thereinto via a port 121 of the bottom plate 12. The port 121 is sealed off by a cap 122. The base 10 is thus stabilized by sand. The base 10 is provided with a tool mount 13 located in the top side thereof, a recess 14 of a length and extending from the rear end thereof to the center thereof, two flat walls 15 opposite to each other and provided with two embossed round pieces 151, each having a tape roll shaft slot 152 and two seat pieces 153 which are provided with a cylinder shaft slot 154. The base 10 is further provided in the top thereof with a protruded block 16 which is in turn provided with a side piece 161 extending therefrom and having in the bottom side thereof a retaining slot 162. As shown in FIGS. 3 and 5, the base 10 is provided in the bottom thereof with a rectangular slot 17, and a receiving space 18 rectangular in its cross section and extending from the center of the slot 17 to the front end of the bottom of the recess 14.

The adhesive tape roll mounting portion 20 is mounted on a rotary wheel 21 which is pivoted to the base 10. The rotary wheel 21 is of a prior art construction and is formed of a triangular seat 211, a sleeve 212 fitted into the center of the seat 211, and a shaft 213 fitted into the axis of the sleeve 212. As shown in FIG. 3, an adhesive tape roll "T" is mounted on the seat 211. A smaller adhesive tape roll may be mounted on the sleeve 212 in place of the seat 211. The shaft 213 is put across the base 10 such that both ends of the shaft 213 are received in the adhesive tape shaft slots 152, and that the adhesive tape roll "T" is capable of turning freely between the two flat walls 15. The adhesive tape roll mounting portion 20 may be modified in various forms to adapt the adhesive tape rolls of various forms.

Figure 4:
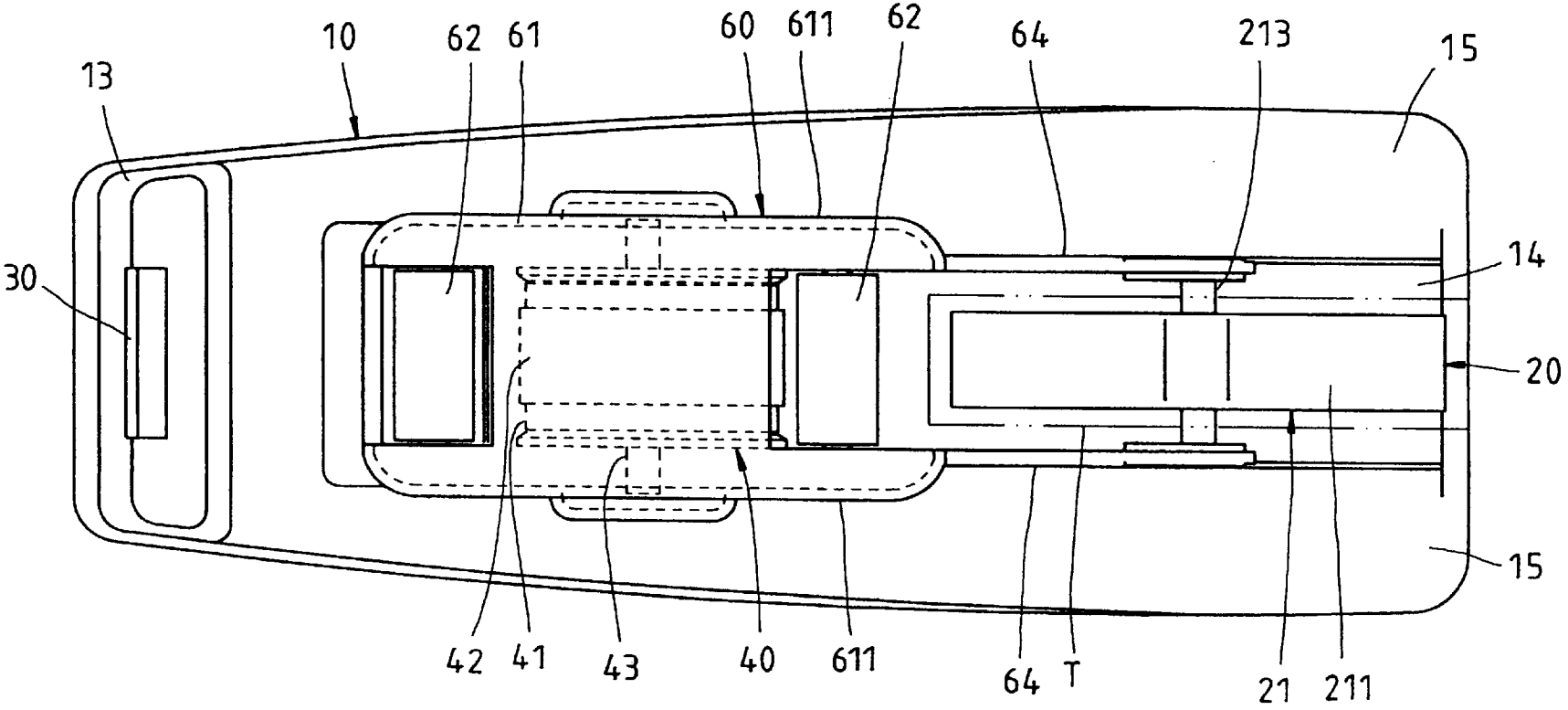
FIG. 4 shows a top view of the preferred embodiment of the present invention as shown in FIG. 2.

The tape cutting tool 30 is a prior art tool commonly used in the adhesive tape dispenser. The tape cutting tool 30 is mounted on the tool mount 13 of the base 10 such that the blade thereof faces upward, and that the blade edge is parallel to the axial line of the rotary wheel 21, as shown in FIG. 4.

The ink supplying device 50 is formed of a seat 51, a revolving shield 52 pivoted to the seat 51, and an ink cylinder 53.

The seat 51 has four side plates (not shown in the drawings) corresponding in location to four sides of the base 10. The left and the right side plates are provided with two axial holes 511 opposite to each other. The left side plate is provided in the inner side thereof with two retaining grooves 512 with an open end facing downward. The front and the rear side plates are provided in the upper portion thereof with an arcuate surface corresponding to the axial hole 511, and in the lower portion thereof with two slits 513. Located between the two slits 513 is a pliable plate 514 which is provided with two sedge-shaped hooks 515. A containing space 517 is formed by the four side plates and the arcuate bottom plate 516.

Figure 7:
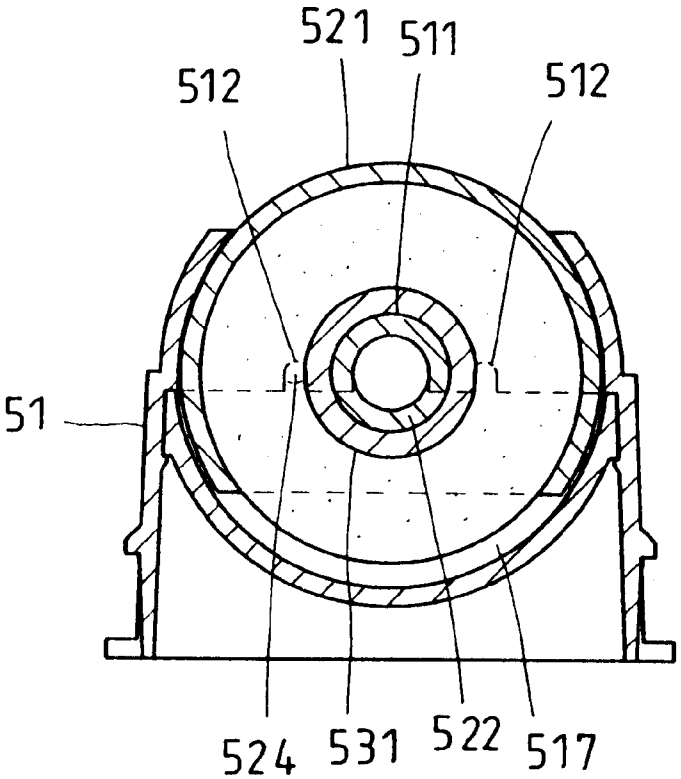
FIGS. 6 and 7 are schematic views showing the relationship between the base and the revolving cover of the ink supplying device of the preferred embodiment of the present invention.
Figure 6:
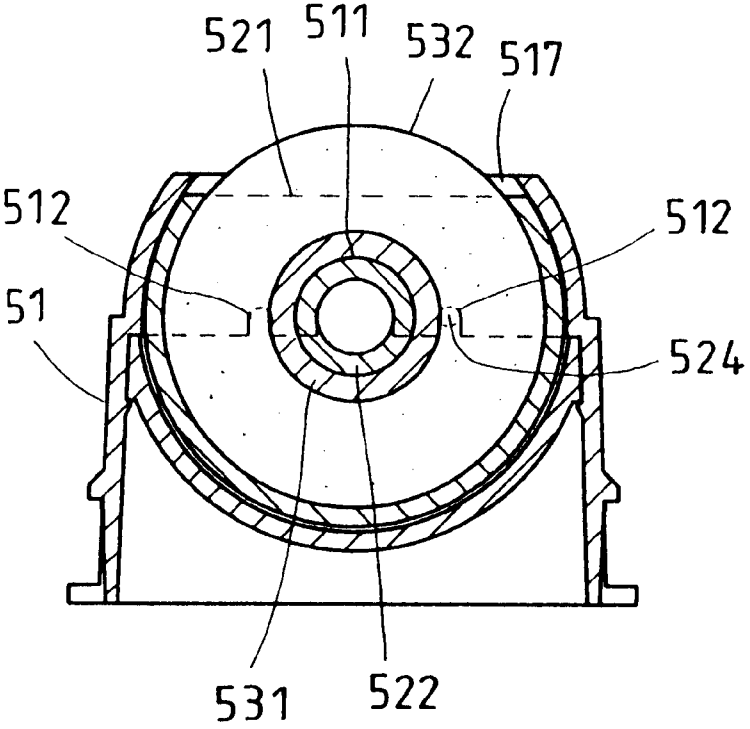

The revolving shield 52 has a shield cylinder 521 corresponding in shape to and smaller in size than the containing space 517. The revolving shield 52 is disposed in the containing space 517 and is provided with a pivot 522 received in the axis thereof such that both ends of the pivot 522 are pivoted in the axial holes 511 of the seat 51, and that one end thereof is provided with a torsion piece 523 for causing the revolving shield 52 to revolve in the seat 51. The shield cylinder 521 is provided with a retaining protruded point 524 corresponding to the retaining grooves 512. The revolving range of the revolving shield 52 is thus confined, as shown in FIGS. 6 and 7. The retaining protruded point 524 is retained between two ultimate positions of the closed end of the retaining grooves 512. When the revolving shield 52 is located at these two positions, the opening of the containing space 517 of the seat 51 is either opened completely or sealed off completely.

The ink cylinder 53 has a shaft tube 531 which is pivotally fitted over the pivot 522 and is provided with a cylindrical sponge 532 fastened on the circumference thereof for absorbing ink. When the revolving shield 52 is located at an ordinary position as shown in FIG. 6, the top side of the sponge 532 is exposed. As the revolving shield 52 is turned to the position as shown in FIG. 7, the top side of the sponge 532 is shielded.

The ink supplying device 50 is detachably mounted in the receiving space 18 of the base 10. The process for mounting the ink supplying device 50 involves a first step in which the bottoms of the two pliable plates 514 of the seat 51 are pressed and then inserted into the receiving space 18 from the bottom side of the base 10. Thereafter the pliable plates 514 are let go such that the wedge-shaped hooks 515 catch the shoulders 181 of the front and the rear walls of the receiving space 18, as shown in FIG. 3. In the meantime, the top side of the sponge 532 of the ink cylinder 53 comes in contact with the bottom side of the printing plate 42 of the printing cylinder 40. As a result, the printing cylinder 40 is actuated to turn on its shaft 43 by the ink cylinder 53 in motion, thereby enabling the ink absorbed by the sponge 532 to pass on to the printing plate 42 continuously.

Figure 8:
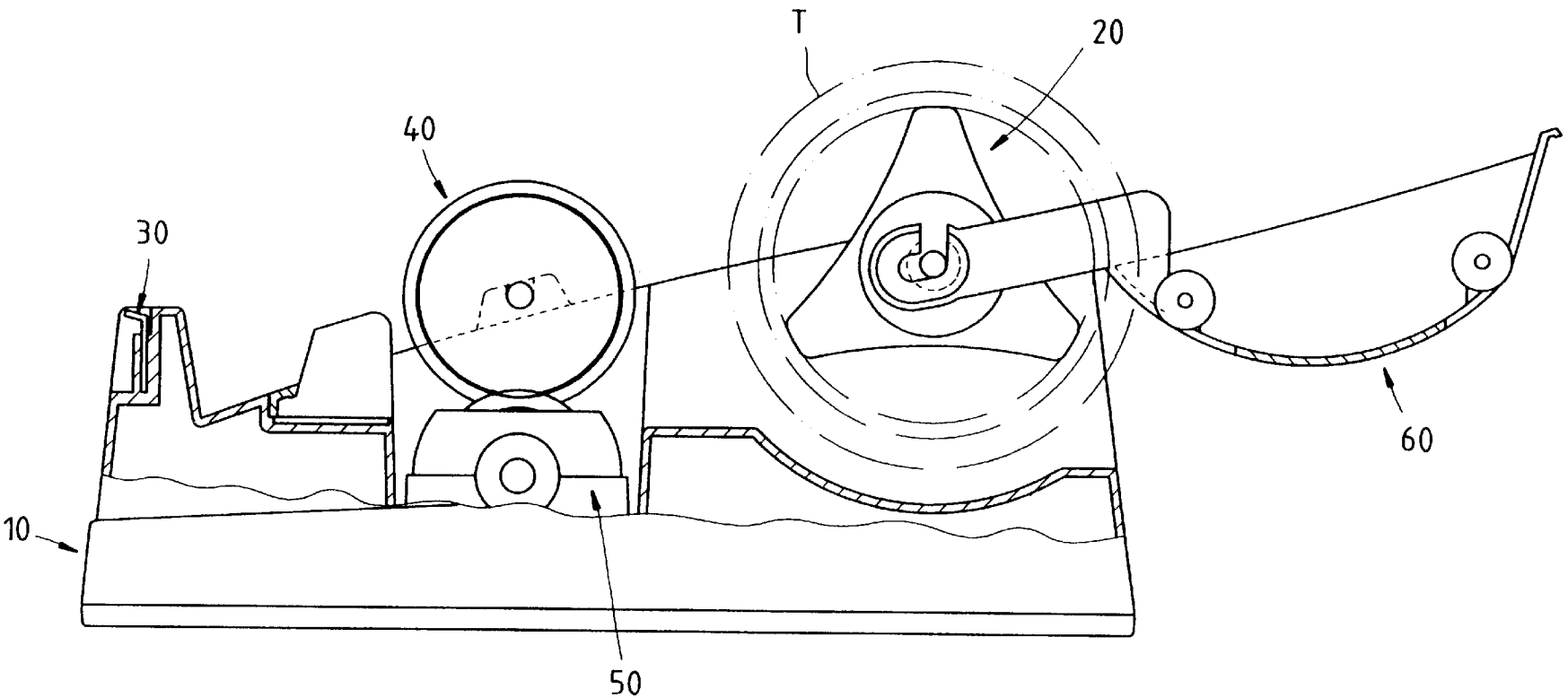
FIG. 8 is similar to FIG. 3 to show the press cover at an open position.

The press cover 60 has a cover body 61 which is formed of two arcuate side plates 611 opposite to each other, and a cover plate 612 connected with the central portion of the arcuate top edge of the two arcuate side plates 611. The cover plate 612 is provided with two cylindrical press members 62 which are fastened pivotally at both ends thereof with the inner sides of the two side plates 611. The side plates 611 are provided at the front end thereof with a retaining hook 63, and at the rear end thereof with a support arm 64. These two support arms 64 are parallel and opposite to each other such that the distance between the outer sides thereof is equal to (or slightly larger than) the distance between the inner sides of the two flat walls 15 of the base 10. The support arms 64 are provided at the tail end thereof with an oval slot 641 and a slit 642. The oval slots 641 retain the two round pieces 151 of the recess 14 of the base 10, thereby enabling the press cover 60 to be fastened pivotally on the top side of the base 10, as shown in FIG. 8 and FIG. 3. When the press cover 60 is located at the open position, both ends of the shaft 213 of the rotary wheel 21 are retained in the adhesive tape shaft slots 152 of the two round pieces 151. The open ends of the slits 642 of the support arms 64 turn upward to be opposite to the shaft slots 152. As the press cover 60 turns forward to cause the open ends of the slits 642 to turn downward. Both ends of the shaft 213 are obstructed by the support arms 64 and are thus located securely in the bottom end of the shaft slots 152. When the press cover 60 is located at the covering position, the top side, the left side and the right side of the printing cylinder 40 are covered by the cover body 61. The two press members 62 are located respectively at the printing cylinder 40 such that the lower side urging point of the circumference thereof is lower than the upper side urging point of the circumference of the printing cylinder 40, as shown in FIG. 3. When the press cover 60 is turned forward and downward, the press cover 60 can be pushed forward, so as to enable the two retaining hooks 63 to engage the two retaining slots 162 of the two protruded blocks 16 of the base 10.

In operation, the press cover 60 is turned backward before the rotary wheel 21 is correctly pivoted on the base 10 such that the dispensing end of the adhesive tape roll "T" faces forward, and that the adhesive side of the adhesive tape roll "T" faces downward. As the adhesive tape is so dispensed such that it is stopped on the cutting tool 30, the press cover 60 is turned forward and then pushed forward so as to secure the press cover 60 in place. The dispensed tape is now located over the printing cylinder 40 and is then forced by the two press members 62 of the press cover 60 to come in close contact with the top side 41 of the printing plate 42, as shown in FIG. 3. As the adhesive tape is pulled out, the printing cylinder 40 is actuated by the adhesive tape to turn. As a result, the ink cylinder 53 is actuated by the printing cylinder 40 in motion, so as to provide the printing plate 42 with a continuous supply of ink. The printing of words or patterns by the printing plate 42 on the dispensed adhesive tape is attained by the letterpress.

The ink supplying device 50 can be taken out from the bottom side of the base 10 so that the device 50 can be replenished with ink. The device 50 full of ink is then put back into the receiving space 16 of the base 10.

The present invention may be provided with a plurality of printing cylinders which are provided with different printing plates for printing a variety of words or patterns on the dispensed adhesive tape.

The printing function of the present invention can be temporarily disabled by turning the revolving shield 52 to locate at the shielding position as shown in FIG. 7, so as to separate the sponge 532 from the printing plate 42. Another simple way to disable temporarily the printing function of the present invention is to remove the ink supplying device 50 from the receiving space 16 of the base 10.

What is claimed is:

1. An adhesive tape dispenser comprising:

a base adapted to rest on a surface;

an adhesive tape roll mounting portion disposed on said base for rotatably mounting an adhesive tape roll;

a tape cutting tool mounted on said base and separated from said adhesive tape roll mounting portion by a distance;

a printing cylinder mounted pivotally on said base such that said printing cylinder is located between said adhesive tape roll mounting portion and said cutting tool, and that an axial line of said printing cylinder is parallel to an axial line of the adhesive tape roll whereby said printing cylinder is provided on a circumference thereof with a printing plate attached thereto and is actuated to turn by a tape that is pulled out of the adhesive tape roll to come in close contact with said printing plate;

an ink supplying device having a seat which is removably mounted in said base such that said seat is contiguous to said printing cylinder whereby said seat is provided with an ink cylinder pivoted thereon for providing the circumference of said printing cylinder with ink at the time when said ink cylinder comes in contact with said printing cylinder; and a press cover movably mounted on a top of said base and having a cover body for covering said printing cylinder whereby said cover body is provided in an inner side thereof with at least one press member for pressing the tape to come in contact with said printing plate;

wherein said base has two flat walls provided in inner sides thereof with two embossed round pieces opposite to each other each having a shaft slot extending from a center thereof, wherein said adhesive tape roll mounting portion has a rotary wheel for mounting the adhesive tape roll, and said rotary wheel has a shaft which is pivoted at both ends thereof in said shaft slots; wherein said press cover is provided with two support arms extending from one end of said cover body thereof whereby said two support arms have two outer sides which are separated from each other by a distance equal to a distance between two inner sides of said two flat walls, said support arms provided at a tail end thereof with a slot and a slit, with said two slots retaining said two round pieces for fastening pivotally said press cover with said base such that said press cover can be turned between an open position and a covering position, and that an open end of said slit is joined with an open end of said shaft slot at such time when said press cover is located at the open position, and further that said printing cylinder is covered by said cover body at such time when said press cover is located at the covering position, and further that the tape is pressed by said press member whereby said cover body is provided at a bottom thereof with at least one retaining hook; wherein said base is provided at a top thereof with a retaining slot; and wherein said press cover is located at said covering position such that said retaining hook is retained in said retaining slot.

2. The adhesive tape dispenser as defined in claim 1, wherein said cutting tool is located at the top of one longitudinal end of said base whereby said top is provided with a recess extending along the direction of a longitudinal axis of said base therefore, said two flat walls of said base corresponding in location to each other; whereby said rotary wheel is pivoted between said two flat walls such that said rotary wheel is far away from said cutting tool; wherein said printing cylinder is pivoted between said two flat walls such that said printing cylinder is near said cutting tool; wherein said base is provided with a receiving space located under said printing cylinder; and wherein said seat of said ink supplying device is removably received in said receiving space such that a top side of a circumference of said ink cylinder is in contact with a bottom side of a circumference of said printing cylinder.

3. The adhesive tape dispenser as defined in claim 2, wherein said receiving space has a rectangular cross section and two shoulders opposite to each other; wherein said base is provided with a slot corresponding to the bottom of said receiving space; wherein said seat of said ink supplying device has four side plates forming a containing space in conjunction with a bottom plate, with two side plates being provided with two slits forming therebetween a pliable plate having a wedge-shaped hook engageable with said shoulder; wherein said ink cylinder has a shaft tube which is pivoted in said containing space whereby said ink cylinder is provided in a circumference thereof with a cylindrical sponge fastened therewith for absorbing ink, said sponge being jutted out of said containing space.

4. The adhesive tape dispenser as defined in claim 3, wherein said containing space is provided with a revolving shield having a shield cylinder of a hollow construction; wherein said shield cylinder is provided with a pivot which is fastened pivotally at both ends thereof with two side plates and provided with a torsion piece for turning said revolving shield; wherein said shaft tube of said ink cylinder is pivotally fitted over said pivot of said revolving shield.

5. The adhesive tape dispenser as defined in claim 4, wherein said seat of said ink supplying device is provided with two retaining grooves; wherein said shield cylinder of said revolving shield is provided with two projections corresponding in location to said two retaining grooves for confining the revolving range of said revolving shield to two positions in which said projections press against the closed ends of said two retaining slots, said containing space being open or covered at such time when said revolving shield is located at said two positions.

6. The adhesive tape dispenser as defined in claim 1, wherein said slot of said support arms of said press cover is oval in shape; wherein said slit is extended from an outer edge of said support arms in a direction toward said tail end of said support arms; wherein said cover body is provided with two retaining hooks corresponding to other end of said support arms; wherein said base is provided in the top thereof with a protruded block which is provided with two side pieces each having said retaining slot.

7. The adhesive tape dispenser as defined in claim 6, wherein said cover body is formed of two arcuate side plates and a cover plate connected with said two side plates; at least one press member is cylindrical in shape and two in number and are fastened pivotally with said two side plates; wherein said two press members are located on the top of said printing cylinder such that a lower side urging point of a circumference thereof is lower than an upper side urging point of said printing cylinder at such time when said press cover is located at said covering position.

8. The adhesive tape dispenser as defined in claim 1, wherein said cover body is formed of two arcuate side plates and a cover plate connected with said two side plates; wherein said at least one press member is cylindrical in shape and two in number and are fastened pivotally with said two side plates; wherein said two press members are located on the top of said printing cylinder such that a lower side urging point of a circumference thereof is lower than an upper side urging point of said printing cylinder at such time when said press cover is located at said covering position.

9. The adhesive tape dispenser as defined in claim 1, wherein said printing plate is provided on the surface thereof with words or patterns and is attached to the circumference of said printing cylinder.

10. The adhesive tape dispenser as defined in claim 1, wherein said base is formed of a top shell and a bottom plate and is provided therein with a receiving compartment, said base further provided in a surface thereof with a port and a cap corresponding to said port whereby said receiving compartment contains sand.

* * * * *